US010883057B2

(12) United States Patent
Lee et al.

(10) Patent No.: US 10,883,057 B2
(45) Date of Patent: Jan. 5, 2021

(54) METHOD FOR SEPARATING NORMAL PARAFFIN AND ISOPARAFFIN FROM HYDROCARBON OIL

(71) Applicants: SK Innovation Co., Ltd., Seoul (KR); SK Energy Co., Ltd., Seoul (KR)

(72) Inventors: Hyeon Hui Lee, Daejeon (KR); Min Su Koo, Daejeon (KR); Young Bin Seo, Daejeon (KR); Hye Ryun Seo, Daejeon (KR); Ju Hoe Kim, Daejeon (KR)

(73) Assignees: SK Innovation Co., Ltd., Seoul (KR); SK Energy Co., Ltd., Seoul (KR)

( * ) Notice: Subject to any disclaimer, the term of this patent is extended or adjusted under 35 U.S.C. 154(b) by 0 days.

(21) Appl. No.: 16/358,885

(22) Filed: Mar. 20, 2019

(65) Prior Publication Data

US 2019/0300802 A1 Oct. 3, 2019

(30) Foreign Application Priority Data

Mar. 28, 2018 (KR) ..... 10-2018-0035982

(51) Int. Cl.

| | |
|---|---|
| ***C10G 67/06*** | (2006.01) |
| ***C10G 49/04*** | (2006.01) |
| ***C10G 69/08*** | (2006.01) |
| *C10G 7/08* | (2006.01) |

(52) U.S. Cl.

CPC ..... *C10G 67/06* (2013.01); *C10G 49/04* (2013.01); *C10G 69/08* (2013.01); *C10G 7/08* (2013.01); *C10G 2300/1081* (2013.01); *C10G 2300/1096* (2013.01); *C10G 2300/4018* (2013.01); *C10G 2400/28* (2013.01)

(58) Field of Classification Search

None

See application file for complete search history.

(56) References Cited

U.S. PATENT DOCUMENTS

| | | | | |
|---|---|---|---|---|
| 4,648,959 | A * | 3/1987 | Herber | C10G 67/06 208/89 |
| 4,690,733 | A * | 9/1987 | Forte | B01D 3/322 203/21 |
| 6,870,073 | B2 * | 3/2005 | Choi | C10G 25/03 585/820 |
| 9,862,656 | B2 | 1/2018 | Kuwana et al. | |
| 2005/0101814 | A1 | 5/2005 | Foley et al. | |
| 2007/0004954 | A1 | 1/2007 | Asaoka et al. | |

FOREIGN PATENT DOCUMENTS

| | | | |
|---|---|---|---|
| JP | 2009179801 | A | 8/2009 |
| JP | 2013159576 | A | 8/2013 |
| KR | 1020060127401 | A | 12/2006 |
| KR | 1020100001796 | A | 1/2010 |
| KR | 1020030038978 | A | 5/2013 |

OTHER PUBLICATIONS

Parkash, S., Refining Processes Handbook, 2003, Elsevier Pub., pp. 29-34. (Year: 2003).*

* cited by examiner

*Primary Examiner* — Derek N Mueller
(74) *Attorney, Agent, or Firm* — The Webb Law Firm

(57) ABSTRACT

Provided is a method for separating normal paraffin and isoparaffin from raffinates of a benzene, toluene, and xylene (BTX) reforming process including C5 to C8 light naphtha, the method including: a liquid hydrogenation process for removing olefin by feeding raffinates in which hydrogen is dissolved into a reactor filled with a hydrogenation catalyst.

13 Claims, 2 Drawing Sheets

METHOD FOR SEPARATING NORMAL PARAFFIN AND ISOPARAFFIN FROM HYDROCARBON OIL

CROSS-REFERENCE TO RELATED APPLICATION

This application claims priority to Korean Patent Application No. 10-2018-0035982 filed Mar. 28, 2018, the disclosure of which is hereby incorporated by reference in its entirety.

TECHNICAL FIELD

The following disclosure relates to a method for separating normal paraffin and isoparaffin from hydrocarbon oil.

BACKGROUND

Raffinates, which are not modified into benzene, toluene, and xylene (BTX), include C5 to C8 light naphtha, which include approximately normal paraffin and isoparaffin, at the time of manufacturing the BTX through reforming during conventional crude purification processes.

Among them, the normal paraffin may be utilized as a high added value solvent product such as nC7, or the like, or as a cracking feed, and the isoparaffin may be blended with gasoline to be used for gasoline production.

Thus, it is required to separate and purify normal paraffin and isoparaffin with high purity and high yield from the raffinates.

Here, one of points to be taken into consideration is that olefin contained in about 5% by weight of the raffinates should be removed. This is because when the normal paraffin and isoparaffin are separated through adsorption, respectively, the olefin may be concentrated into adsorbent pores filled in an adsorption column or may allow the adsorbent to be deactivated due to formation of oligomers, and thus a separation efficiency of the normal paraffin and the isoparaffin may be lowered.

SUMMARY

An embodiment of the present disclosure is directed to providing a method for separating normal paraffin and isoparaffin with high purity and high yield from raffinates that are not modified into benzene, toluene, and xylene (BTX) at the time of manufacturing the BTX through reforming during crude purification processes, thereby increasing commercial availability to create a high added value of the normal paraffin and isoparaffin, respectively.

In one general aspect, there is provided a method for separating normal paraffin and isoparaffin from raffinates of a benzene, toluene, and xylene (BTX) reforming process including C5 to C8 light naphtha, the method including: a liquid hydrogenation process for removing olefin by feeding raffinates in which hydrogen is dissolved into a reactor filled with a hydrogenation catalyst.

The liquid hydrogenation process may be performed under conditions satisfying Equations 1 and 2 below:

$$16 \leq A_1/A_2 \leq 35 \quad \text{[Equation 1]}$$

$$1.5 \leq A_3/A_2^4 \leq 2.5 \quad \text{[Equation 2]}$$

in Equations 1 and 2, $A_1$ is a space velocity ($Hr^{-1}$) of reactants in the reactor, $A_2$ is a ratio of a molar amount of dissolved hydrogen gas with respect to a molar amount of olefin in the raffinates in which hydrogen is dissolved, and $A_3$ is a space velocity ($Hr^{-1}$) of the raffinates in which hydrogen is dissolved in the reactor.

In the liquid hydrogenation process, a ratio of a molar amount of dissolved hydrogen gas with respect to a molar amount of olefin in the raffinates in which hydrogen is dissolved may be 1.0 to 1.5.

The liquid hydrogenation process may be performed at a temperature outside the reactor of 45 to 55° C. and a pressure in the reactor of 15 to 30 kg/cm$^2$ g.

The liquid hydrogenation process may have a recycle ratio of 2.5 to 5.0.

The space velocity in the reactor of the raffinates in which hydrogen is dissolved may be 6 to 10 hr$^{-1}$.

The raffinates may include, with respect to the total amount of 100% by weight, 15 to 30% by weight of normal paraffin, 45 to 70% by weight of isoparaffin, 3 to 10% by weight of olefin, and a remaining percent by weight of other impurities.

The raffinates may include 10 to 15% by weight of C6 normal paraffin with respect to the total amount of 100% by weight.

The method may further include, after the liquid hydrogenation process, an adsorption process for separating normal paraffin and isoparaffin.

The adsorption process may include a) passing an effluent of the liquid hydrogenation process through an adsorption column filled with a zeolite adsorbent in a gaseous state to selectively adsorb normal paraffin and discharging unadsorbed isoparaffin-containing oil to the outside of the adsorption column; b) discharging the isoparaffin-containing oil remaining between the zeolite adsorbent particles from the adsorption column by concurrently purging butane after step a); and c) desorbing and discharging the normal paraffin adsorbed in pores of the zeolite adsorbent by countercurrent purging with the butane after step b).

The method may further include: d) separating a mixture of the normal paraffin and butane discharged in step c) from each other by distillation in an extract column, separating a mixture of the isoparaffin-containing oil and butane discharged in steps a) and b) from each other by distillation in a raffinate column, and recycling the separated butane to the adsorption column.

In the adsorption process, steps a) to c) may be sequentially performed in each adsorption column in a continuous circulation manner using at least three or more adsorption columns, and a switching time of each adsorption column may be determined by analyzing the raffinates and effluent components of the adsorption column online in real time.

In steps b) and c), butane having a normal butane content of 70 to 100% by weight may be used.

Steps a) to c) may be performed under conditions in which a temperature is 150 to 400° C., a pressure is 5 to 20 kg/cm$^2$ g, and a space velocity of raw materials fed into the adsorption column is 1 to 10 hr$^{-1}$.

When the switching time is determined, the online analysis may be performed using a near-infrared analysis system.

DETAILED DESCRIPTION OF EMBODIMENTS

Figure 1:
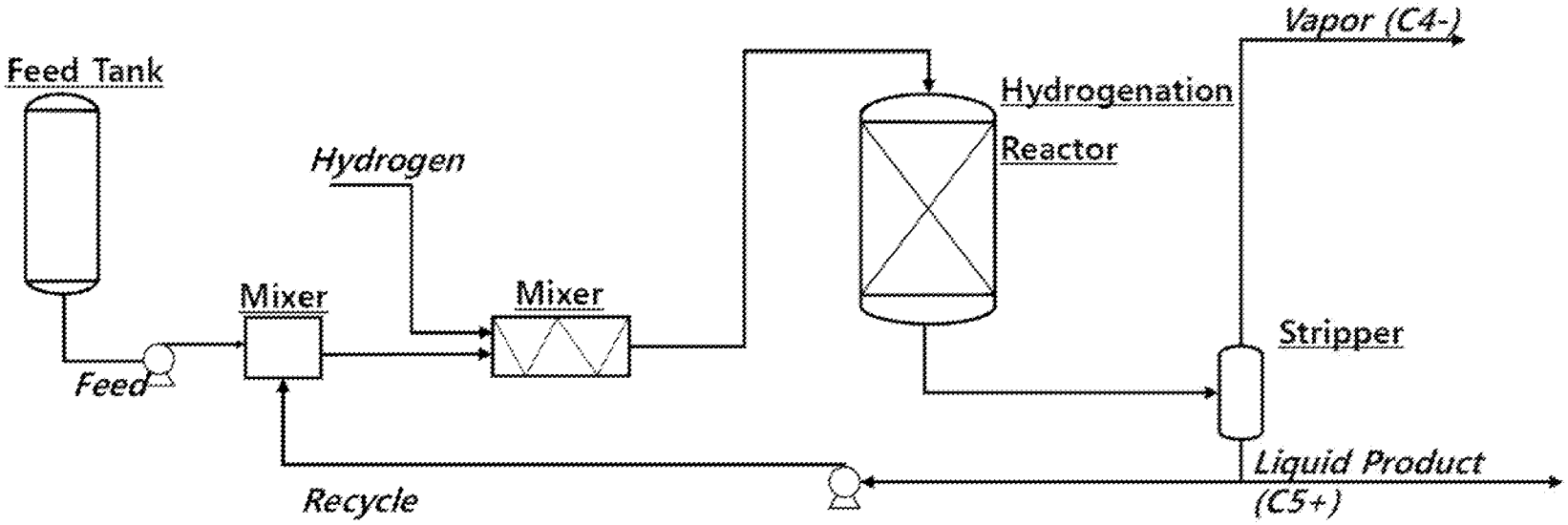
FIG. 1 is an exemplary schematic diagram of a liquid hydrogenation process of an embodiment of the present disclosure.

Unless otherwise defined, all terms (including technical and scientific terms) used in the present specification may be used with meanings that are commonly understandable by those skilled in the art to which the present disclosure pertains. Throughout the present specification, unless explicitly described to the contrary, "comprising" any components will be understood to imply the inclusion of other elements rather than the exclusion of any other elements. Unless explicitly described to the contrary, a singular form also includes a plural form in the present specification.

According to an embodiment of the present disclosure, there is provided a method for separating normal paraffin and isoparaffin from raffinates of a benzene, toluene, and xylene (BTX) reforming process including C5 to C8 light naphtha, the method including: a liquid hydrogenation process for removing olefin by feeding raffinates in which hydrogen is dissolved into a reactor filled with a hydrogenation catalyst.

The raffinates may include, with respect to the total amount of 100% by weight, 15 to 30% by weight of normal paraffin, 45 to 70% by weight of isoparaffin, 3 to 10% by weight of olefin, and a remaining percent by weight of other impurities. Other impurities may include 3 to 10% by weight of naphthene, 1 to 5% by weight of aromatic components, and a small amount of water, sulfolane, and the like. In addition, the raffinates may include 10 to 15% by weight of C6 normal paraffin and 3 to 8% by weight of C7 normal paraffin with respect to the total amount of 100% by weight within a range satisfying the above-described composition, which may be utilized as a solvent with a high concentration and a high added value through an additional process after the normal paraffin is separated.

In the present specification, the term "liquid hourly space velocity (LHSV)" may be calculated by dividing a feeding flow amount of raw materials fed into a reactor by a volume in the reactor, and the volume in the reactor means a volume of a space through which the raw materials may flow, including a space filled with the catalyst in the reactor and a space between the catalysts.

According to the method for separating normal paraffin and isoparaffin of an embodiment of the present disclosure, the normal paraffin and the isoparaffin may be separated and purified with high purity and a high recovery rate from the raffinates of a BTX reforming process. Accordingly, the normal paraffin may be utilized as a high added value solvent product such as nC7, or the like, or as a cracking feed, and the isoparaffin may be blended with gasoline to be used for gasoline production, and thus it is possible to achieve a high added value of the total crude oil production process.

In the present specification, the term 'isoparaffin' may mean a paraffin other than the normal paraffin among paraffins.

The method for separating normal paraffin and isoparaffin according to an embodiment of the present disclosure may lower a content of olefin in the raffinates to less than 0.1% by weight by performing a liquid hydrogenation process before separating the normal paraffin and the isoparaffin such as an adsorption process, or the like. Accordingly, a problem that the olefin in raw materials is concentrated into adsorbent pores filled in an adsorption column or allows the adsorbent to be deactivated due to formation of oligomers in a post-process may be solved, thereby preventing purity and a recovery rate of the finally separated normal paraffin and isoparaffin from being reduced, and thus the purity and the recovery rate thereof may be improved. Further, since a regeneration process according to a deactivating agent of the adsorbent is not additionally required, the process may be simplified to reduce a plant cost, a maintenance cost, and an operation cost, which may greatly enhance industrial applicability.

In addition, the liquid hydrogenation reaction may be operated at a low temperature of about 50° C., and thus heat duty is small, and the amount of hydrogen required to be added is an amount in which hydrogen is dissolved, and thus it is not necessary to provide a compressor for recycling separately. Further, since it is not necessary to provide a separation device for gas-liquid separation, the normal paraffin and the isoparaffin may be recovered with high purity and a high recovery rate in a post-process, while simultaneously simplifying an entire plant and greatly enhancing economical efficiency of the process.

In the method for separating normal paraffin and isoparaffin of an embodiment of the present disclosure, the liquid hydrogenation process may be preferably performed under conditions satisfying Equations 1 and 2 below:

$$16 \leq A_1/A_2 \leq 35 \quad \text{[Equation 1]}$$

$$1.5 \leq A_3/A_2^4 \leq 2.5 \quad \text{[Equation 2]}$$

in Equations 1 and 2, $A_1$ is a space velocity ($Hr^{-1}$) of reactants in the reactor, $A_2$ is a ratio of a molar amount of dissolved hydrogen gas with respect to a molar amount of olefin in the raffinates in which hydrogen is dissolved, and $A_3$ is a space velocity ($Hr^{-1}$) of the raffinates in which hydrogen is dissolved in the reactor.

Here, the space velocity of the reactant in the reactor in Equation 1 means a space velocity of the entire reactant taking into consideration a feeding flow amount and a recycling flow amount of the raw materials raffinates. Equation 1 indicates a relationship between the space velocity of the reactants in the reactor of the liquid hydrogenation process and the ratio of the molar amount of hydrogen gas with respect to the molar amount of olefin in the raw material raffinates in which hydrogen is dissolved (i.e., a molar amount of hydrogen gas/a molar amount of olefin, hereinafter referred to as a hydrogen margin), wherein it is required to set a hydrogen margin to a predetermined level or more in order to remove the olefin in the raffinates. Meanwhile, in order to increase the hydrogen margin, a recycle ratio of the liquid hydrogenation process is required to be increased in consideration of solubility of hydrogen, and thus the total space velocity increases. Here, if the space velocity is excessively low, side reactions, or the like, may be generated, and thus an olefin removing efficiency may be lowered. If the space velocity is excessively high, it may be difficult to generate the hydrogenation reaction sufficiently, and thus it is preferable to adjust the space velocity so as to satisfy a specific range therebetween, and it may be preferable to satisfy the above Equation 1.

Equation 2 indicates a relationship between the hydrogen margin and the space velocity of the raffinates in the reactor except recycling flow amount (i.e., the space velocity of only the raw materials raffinates fed into an inlet of the reactor). If the raffinates are fed at an excessively high space velocity, a recycling amount based on the same recycle ratio may also increase, and thus the space velocity of the entire reactant may be excessively fast. Therefore, it is required to maintain the space velocity of only the raffinates that are capable of maintaining a proper space velocity of the entire reactant while maintaining the hydrogen margin. Therefore, it may be preferable to satisfy Equation 2 above.

Preferably, it may be preferable to satisfy both the Equations 1 and 2 above.

In the method for separating normal paraffin and isoparaffin of an embodiment of the present disclosure, the ratio of the molar amount of dissolved hydrogen gas with respect to the molar amount of olefin in the raffinates in which hydrogen is dissolved in the liquid hydrogenation process may be preferably 1.0 to 1.5. More specifically, the ratio thereof may be 1.25 to 1.4. However, the present disclosure is not limited thereto.

By satisfying these conditions, the content of the olefin in the raffinates may be lowered to less than 0.1% by weight. Thus, the problem that the olefin in raw materials is concentrated into adsorbent pores filled in an adsorption column or allows the adsorbent to be deactivated due to formation of oligomers in a post-process may be solved.

In the method for separating normal paraffin and isoparaffin according to an embodiment of the present disclosure, the liquid hydrogenation process may be performed at a temperature outside the reactor of 45 to 55° C. and a pressure in the reactor of 15 to 30 kg/cm$^2$ g. However, the present invention is not limited thereto. As described above, the process is capable of being performed in this temperature range, and thus the heat duty of the liquid hydrogenation process is small, and hydrogen is required to be added only at an amount in which hydrogen is dissolved, and thus it is not necessary to provide a compressor for recycling separately. Further, since it is not necessary to provide a separation device for gas-liquid separation, the plant may be simplified, and the economical efficiency of the process may be greatly enhanced.

In the method for separating normal paraffin and isoparaffin according to an embodiment of the present invention, the space velocity in the reactor of the raffinates in which hydrogen is dissolved in the liquid hydrogenation process may be to 10 hr$^{-1}$, and more specifically, 6 to 9.5 hr$^{-1}$, and the recycle ratio may be 2.5 to 5.0, and more specifically, 2.9 to 4.3. However, the present invention is not limited thereto.

The recycle ratio may be defined as a ratio of a volume of a mixture that is recycled from a rear end to a front end of the liquid hydrogenation process with respect to a volume of the raffinates fed into the liquid hydrogenation process. In an embodiment of the present invention, the space velocity and the recycle ratio of the raffinates in the reactor may be satisfied to remove the olefin to less than 0.1% by weight in the liquid hydrogenation process.

Upon further explaining a process aspect of the liquid hydrogenation process, the liquid hydrogenation process may be performed using a fixed bed reactor. Specifically, the raffinates in the liquid phase may be continuously injected in a countercurrent direction or in a concurrent direction in the fixed bed reactor filled with the hydrogenation catalyst and hydrogen, and hydrogenated.

Further, if necessary, two or more reactors may be provided, but this is merely an example, and thus the present invention is not limited thereto.

As the hydrogenation catalyst, more specifically, a catalyst in which a metal catalyst is supported on a support for assisting a catalytic activity may be used.

Here, the metal catalyst may be an nickel (Ni), platinum (Pt), palladium (Pd), rhodium (Rh), lutetium (Lu), or an alloy including two or more of these metals such as a platinum-palladium alloy, and the support may be alumina ($Al_2O_3$), silica ($SiO_2$), titania ($TiO_2$), zirconia ($ZrO_2$), zeolite, a clay material or a combination thereof, but the metal catalyst and the support are not limited thereto.

Further, an amount of the metal catalyst supported on the support may be, for example, 10 to 40% by weight, more specifically 15 to 30% by weight, based on 100% by weight of the metal catalyst supported on the support.

The method for separating normal paraffin and isoparaffin according to an embodiment of the present invention may further include, after the liquid hydrogenation process, an adsorption process for separating normal paraffin and isoparaffin.

The normal paraffin and the isoparaffin may be separated from each other with high purity through the adsorption process.

The adsorption process may include a) passing an effluent of the liquid hydrogenation process through an adsorption column filled with a zeolite adsorbent in a gaseous state to selectively adsorb normal paraffin and discharging unadsorbed isoparaffin-containing oil to the outside of the adsorption column; b) discharging the isoparaffin-containing oil remaining between the zeolite adsorbent particles from the adsorption column by concurrently purging butane after step a); and c) desorbing and discharging the normal paraffin adsorbed in pores of the zeolite adsorbent by countercurrent purging with the butane after step b).

In the adsorption process, butane is used as a desorption gas, and therefore, it is possible to provide excellent desorption performance (desorption amount depending on a desorbent flow amount per unit time), thereby reducing piping and an apparatus size of the entire process including an adsorption column, thus resulting in improved economical efficiency. Further, since butane may be recovered in a liquid phase and recycled, there is no need to use a compressor, which is expensive equipment, thus resulting in reduction of the investment cost. In addition, the desorption performance is excellent, and thus productivity of the process may be greatly enhanced.

As the desorbent, butane may preferably contain 70 to 100% by weight of normal butane.

The adsorption method may further include: d) separating a mixture of the normal paraffin and butane discharged in step c) from each other by distillation in an extract column, separating a mixture of the isoparaffin-containing oil and butane discharged in steps a) and b) from each other by distillation in a raffinate column, and recycling the separated butane to the adsorption column.

Specifically, an effluent including the mixture of normal paraffin and butane and an effluent including a mixture of isoparaffin-containing oil and butane may be purified by distillation at a temperature of 60 to 200° C. and a pressure of 6 to 8 kg/cm$^2$ g. Thus, normal paraffin and isoparaffin products may have a purity of 98% by weight or more and may be recovered at a recovery rate of 98% or more.

Here, butane which is the desorbent may be recovered in the liquid phase and recycled.

Steps a) to c) in the adsorption process are not particularly limited, but may be performed under conditions in which a temperature is 150 to 400° C., a pressure is 5 to 20 kg/cm$^2$ g, and a space velocity of raw materials fed into the adsorption column is 1 to 10 h$^{-1}$, wherein the temperature may be more specifically 200 to 300° C. or 230 to 250° C.

The adsorbent is not particularly limited, but specifically the adsorbent may preferably have pores of 5A or less such as zeolite 5A, or the like, which is advantageous for adsorption of the normal paraffin.

Further, in the adsorption process, steps a) to c) may be sequentially performed in each adsorption column in a continuous circulation manner using at least three or more adsorption columns, and a switching time of each adsorption column may be determined by analyzing the raffinates and effluent components of the adsorption column online in real time. Further, when the switching time is determined, the online analysis may be performed using a near-infrared analysis system.

More specifically, when normal paraffin and isoparaffin-containing oil are separated using one adsorption column, the normal paraffin and oil other than the normal paraffin are produced intermittently. Therefore, in order to continuously separate the normal paraffin and the oil other than normal paraffin in the commercialization process, at least three adsorption columns are required, wherein one adsorption column is needed in an adsorption process, another adsorption column is needed in a purging process, and the other adsorption column is needed in a desorption process. In this way, it is possible to continuously produce the normal paraffin and the oil other than normal paraffin through three steps, wherein each process is required to be changed at an appropriate time interval. In order to perform commercial continuous production, it is suitable that time for adsorption and time for desorption are the same as each other, and time for purging is half of the time for adsorption and for desorption, and thus it may be preferable to install a total of six adsorption columns by disposing two adsorption columns at the adsorption process, one adsorption column at the purging step, and two adsorption columns at the desorption step, and further adding one preliminary adsorption column.

Two most important variables in determining the optimum switching time between adsorption columns may be a change in the normal paraffin content in the raw material and a reduction phenomenon according to an operation time of an adsorption capacity of a zeolite molecular sieve depending on repetition or regeneration of the long adsorption/desorption process. The adsorption process and the separation process according to the change of these two variables may be controlled to affect the economical efficiency. The optimum switching time may be determined in two ways. A first method is to construct an accurate process model that measures normal paraffin in raw materials to calculate an optimum time for specific raw materials and process conditions, and a second method is to monitor a content of a component (normal paraffin) to be adsorbed to determine the time to switch the adsorption column before the normal paraffin is contaminated. For a strategy to control these two methods, it is required to perform rapid, accurate, and precise online analytical techniques with respect to the normal paraffin content of raw materials and normal paraffin products.

In general, gas chromatography (GC) analysis is used for the analysis of normal paraffin content. However, when considering that the GC analysis generally takes 20 minutes or more and the switching time of the adsorption column is about 2 to 10 minutes, there are disadvantages in that it takes a long time to quickly detect a change of process performance due to the change of the raw materials or reduction in performance of the adsorbent and to optimize operation variables of the process.

Therefore, in the present invention, a method for analyzing the normal paraffin content in real time in the whole range of naphtha raw materials and effluents of the adsorption column using a near-infrared analysis system having a short analysis time and excellent reproducibility and reliability as an online analyzer and determining the optimum switching time according to the analysis result, is applied. The near-infrared analysis system is to simultaneously measure normal paraffin oil online by transmitting near-infrared (wavelength of 1100 nm to 2500 nm) light using an optical fiber. Specifically, the near-infrared analysis system is designed so that samples are taken at two sampling points, i.e., one point for measuring the normal paraffin content in the raw materials at a front end of the adsorption column and the other point where the mixture of butane and the oil other than normal paraffin passes through at a rear end of the adsorption column, and are measured simultaneously with one near-infrared analyzer. Here, the near-infrared analysis system may be operated by measuring normal paraffin in the oil other than the normal paraffin at the above point so that the normal paraffin does not exceed the reference value.

The near-infrared analyzer used in the present invention is any conventional near-infrared analyzer without limitation. Upon reviewing a principle for measurement, overtone and combination absorption bands of hydrocarbons appear in the near-infrared region of the analyzer, and each hydrocarbon has a unique absorption band. In the case of a hydrocarbon mixture, it is impossible to separate and measure respective compositions since the respective unique absorption bands are overlapped with each other, and thus each composition may be separated using a multi-variate regression which is a statistical technique.

Hereinafter, preferred examples and comparative examples of the present invention will be described. However, the following Examples are only provided as a preferable embodiment of the present invention, and the present invention is not limited to the following Examples.

1. Liquid Hydrogenation Process

The liquid hydrogenation reaction was performed in the same manner as in FIG. 1 using raffinates of a BTX reforming process with the composition of Table 1 below as raw materials, and process conditions of each process and an olefin content in the raffinates after the liquid hydrogenation process are summarized in Table 2 below.

A fixed bed reactor filled with a Ni/Alumina supported catalyst in which 28% by weight of Ni was supported was used. A temperature outside the reactor means a temperature that is set to maintain a constant temperature from the outside when the raffinates which are reactants are in contact with the catalyst bed and the reaction proceeds. In a commercial process, this temperature was replaced with a reactor inlet temperature before contacting the catalyst bed, and this temperature was adjusted to 50° C.

TABLE 1

| Classification | Normal paraffin | Isoparaffin | Naphthene | Aromatic | Olefin | Other impurities | Total |
|---|---|---|---|---|---|---|---|
| Content | 25.29% by weight (11.89% by weight of C6 | 61.31% by weight (28.13% by weight of C6 | 6.68% by weight | 1.96% by weight | 4.75% by weight | Water (100 to 130 ppm), and Sulfolane (5 to 200 ppm) | 100% by weight |

TABLE 1-continued

| Classification | Normal paraffin | Isoparaffin | Naphthene | Aromatic | Olefin | Other impurities | Total |
|---|---|---|---|---|---|---|---|
| | component and 5.85% by weight of C7 component) | component and 20.53% by weight of C7 component) | | | | | |

In Table 1, the unit "% by weight" means % by weight based on 100% by weight in total of raffinates.

TABLE 2

| Case | Example 1 | Example 2 | Comparative Example 1 | Example 3 | Comparative Example 2 | Example 4 | Example 5 | Comparative Example 3 | Example 6 | Comparative Example 4 | Example 7 | Comparative Example 5 |
|---|---|---|---|---|---|---|---|---|---|---|---|---|
| Pressure ($kg/cm^2g$) | 18 | 18 | 18 | 18 | 18 | 18 | 18 | 18 | 18 | 18 | 27 | 30 |
| $H_2$ Margin in fed raffinates (based on molar amount) ($H_2$/Olefin, $A_2$) | 1.4 | 1.4 | 1.4 | 1.35 | 1.35 | 1.3 | 1.3 | 1.3 | 1.25 | 1.2 | 1.4 | 1.4 |
| Recycle ratio | 4.3 | 4.3 | 4.3 | 4.2 | 4.2 | 4.0 | 4.0 | 4.0 | 3.9 | 3.7 | 2.9 | 2.4 |
| LHSV ($h^{-1}$) | | | | | | | | | | | | |
| Based on fed raffinates ($A_3$) | 7.0 | 9.0 | 10.0 | 8.0 | 9.0 | 6.0 | 7.0 | 8.0 | 6.0 | 4.0 | 9.5 | 10.3 |
| Including recycling amount ($A_1$) | 37.1 | 47.7 | 53 | 41.6 | 46.8 | 30 | 35 | 40 | 29.4 | 18.8 | 37.05 | 35.122 |
| Relationships among $A_1$ to $A_3$ | | | | | | | | | | | | |
| $A_1/A_2$ | 26.5 | 34.1 | 37.9 | 30.8 | 34.7 | 23.1 | 26.9 | 30.8 | 23.5 | 15.7 | 26.5 | 25.1 |
| $A_3/A_2^4$ | 1.8 | 2.3 | 2.6 | 2.4 | 2.7 | 2.1 | 2.5 | 2.8 | 2.5 | 1.9 | 2.5 | 2.7 |
| Temperature (° C.) | | | | | | | | | | | | |
| Inlet of reactor | 50 | 50 | 50 | 50 | 50 | 50 | 50 | 50 | 50 | 50 | 50 | 50 |
| Result analysis | | | | | | | | | | | | |
| Olefin <0.1% by weight | ○ | ○ | X | ○ | X | ○ | ○ | X | ○ | X | ○ | X |

2. Adsorption Process

Figure 2:
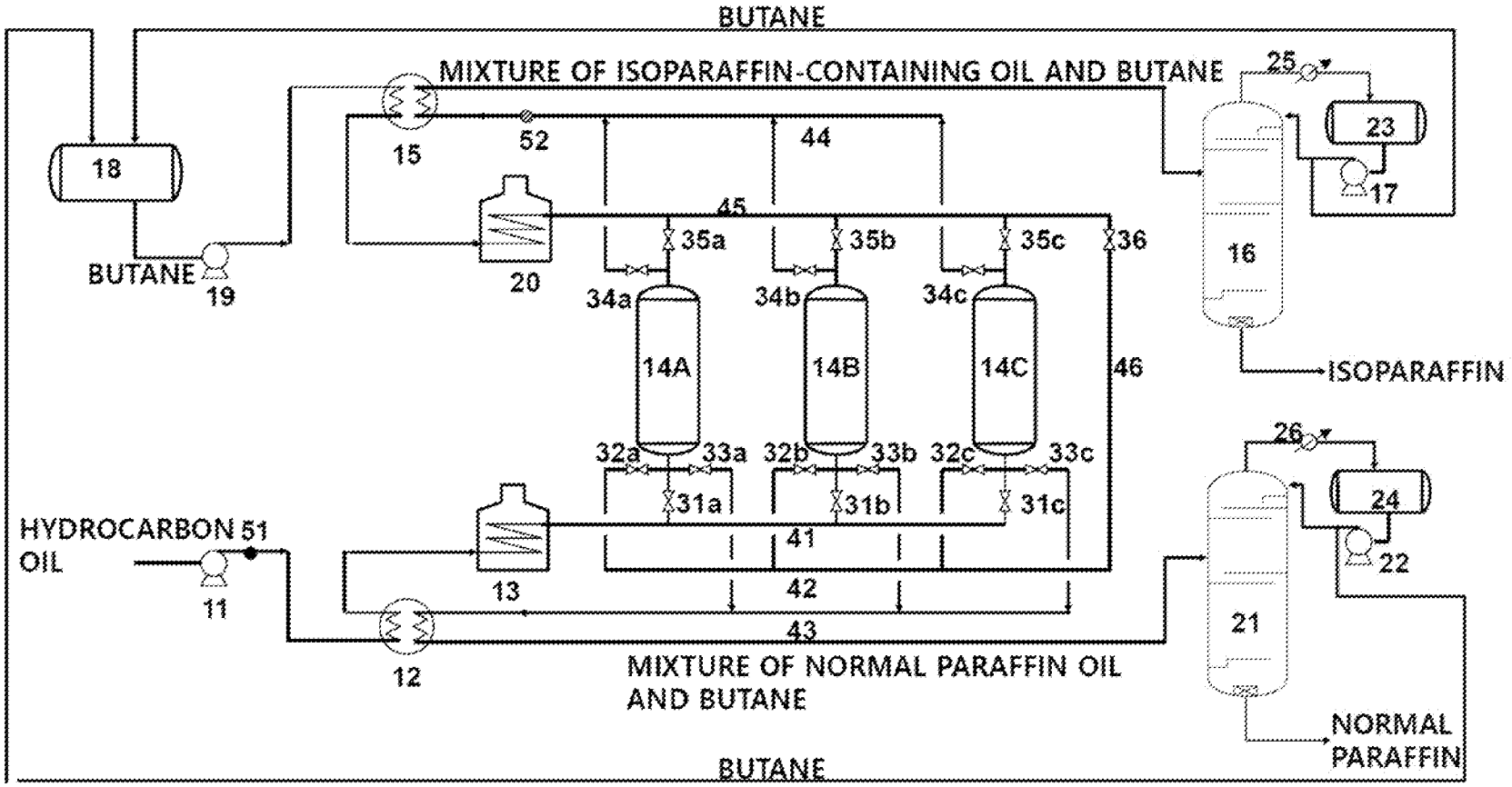
FIG. 2 is an exemplary schematic diagram of an adsorption process of an embodiment of the present disclosure.

After the liquid hydrogenation process, the raffinates in a gas state of Examples and Comparative Examples were fed into an adsorption process as shown in FIG. 2 to separate normal paraffin and isoparaffin. Each adsorption column was a fixed bed adsorption column filled with zeolite molecular sieve 5A and operated under conditions in which a temperature was 250° C., a pressure was 10 $kg/cm^2$ g, and a raffinate space velocity (LHSV) was 1.62 $h^{-1}$. Butane containing 90% by weight of normal butane was used as a desorbent. After the adsorption process was performed for 5 minutes, butane was fed by concurrent flow and purging was performed for 2.5 minutes which was half of the adsorption time, and the desorption process was performed by countercurrently feeding butane for 5 minutes.

In more specifically describing this process with reference to FIG. 2, after the liquid hydrogenation process, the raffinates were heated through a heat exchanger 12 and a heating furnace 13 and supplied in a gas state to the adsorption column 14A through a pipe 41 and a control valve 31*a* at a pressure of $kg/cm^2$ g, thereby performing the adsorption process. In the adsorption column 14B and the adsorption column 14C, the same processes as those of the adsorption column 14A are sequentially repeated, and thus descriptions will be provided based on the adsorption column 14A.

Through the adsorption process, the isoparaffin-containing oil is discharged to the outlet of the adsorption column 14A and is moved to a pipe 44 through a control valve 34*a*. Here, butane that remained while desorbing the normal paraffin was included, and after a predetermined time passed through according to an adsorption capacity of the adsorbent, the control valve 31*a* was closed to stop the supply of the raffinates.

The isoparaffin-containing oil discharged to the outlet of the adsorption column 14A was mixed with the effluent of the purging step to be described below, merged at the pipe 44 through the control valve 34*a*, and cooled in the heat exchanger 15. Then, the cooled product was transferred to a raffinate separation column 16 to separate isoparaffin. Butane was separated from the top of the column and the separated butane was phase-changed into liquid while maintaining the temperature in the heat exchanger 25, transferred to a recycling drum 18 through a reflux pump 17, then pressurized and heated at a pump 19 and a heating furnace 20, and recycled to the process.

When the adsorption process was completed, butane, which is a purging material, was supplied from a pipe 45 to a pipe 42 through the control valve 36 and concurrently fed into the adsorption column 14A through the control valve 32*a*. The effluent of the purging step was transferred to the pipe 44 through the control valve 34*a*, mixed with a discharged product of the adsorption process and fed into the heat exchanger 15.

When the concurrent purging process was completed, the butane in a gas state that was heated through the heating furnace 20 was countercurrently fed from the pipe 45 through the control valve 35*a* to the adsorption column 14A. The normal paraffin pushed through the countercurrent purging was transferred to the pipe 43 through the control valve 33*a*.

The normal paraffin-containing mixture transferred to the pipe 43 was then cooled through the heat exchanger 12 and fed into an extract separation column 21 to separate the normal paraffin. The butane separated from the top of the extract separation column was phase-changed into liquid while maintaining the temperature in the heat exchanger 26 and was transferred to the recycling drum 18 through the reflux pump 22.

The near-infrared analysis system was designed so that samples were taken at two sampling points, i.e., one point 51 for measuring the normal paraffin content in the raw materials at a front end of the adsorption column and the other point 52 where the mixture of butane and the oil other than normal paraffin passed through at a rear end of the adsorption column, and were measured simultaneously with one near-infrared analyzer. Here, the near-infrared analysis system was operated by measuring normal paraffin in the isoparaffin-containing oil other than the normal paraffin at the above point 52 so that the normal paraffin did not exceed the reference value.

The purity and recovery rate of the finally separated normal paraffin and isoparaffin were measured and calculated, and as a result, both of the normal paraffin and the isoparaffin in Examples showed the purity of 98% by weight or more and the recovery rate of 98% or more.

In Comparative Examples, the purity was about 95% by weight and the recovery rate was about 93%, and thus it could be confirmed that the purification efficiency of Comparative Examples were lower than those of Examples.

The recovery rate was calculated by comparing the weight of normal paraffin or isoparaffin in the raffinates fed to the liquid hydrogenation process with the weight of the finally separated normal paraffin or isoparaffin.

According to an embodiment of the present disclosure, there is provided the method for separating normal paraffin and isoparaffin with high purity and high yield from raffinates that are not modified into benzene, toluene, and xylene (BTX) at the time of manufacturing the BTX through reforming during crude purification processes, thereby increasing commercial availability to create a high added value of the normal paraffin and isoparaffin, respectively.

What is claimed is:

1. A method for separating normal paraffin and isoparaffin from raffinates of a benzene, toluene, and xylene (BTX) reforming process including C5 to C8 light naphtha, the method comprising:

a liquid hydrogenation process for removing olefin by feeding raffinates in which hydrogen is dissolved into a reactor filled with a hydrogenation catalyst, and after the liquid hydrogenation process, an adsorption step for separating normal paraffin and isoparaffin is performed, wherein the liquid hydrogenation process is performed under conditions satisfying Equations 1 and 2 below:

$$16 \leq A_1/A_2 \leq 35 \quad \text{[Equation 1]}$$

$$1.5 \leq A_3/A_2^4 \leq 2.5 \quad \text{[Equation 2]}$$

wherein in Equations 1 and 2, $A_1$ is a space velocity ($Hr^{-1}$) of reactants in the reactor, $A_2$ is a ratio of a molar amount of dissolved hydrogen gas with respect to a molar amount of olefin in the raffinates in which hydrogen is dissolved, $A_3$ is a space velocity ($Hr^{-1}$) of the raffinates in which hydrogen is dissolved in the reactor, and the reactants in the reactor are a mixture of the raffinates in which hydrogen is dissolved and a mixture that is recycled from a downstream part of the process to said reactor of the liquid hydrogenation process.

2. The method of claim 1, wherein in the liquid hydrogenation process, a ratio of a molar amount of dissolved hydrogen gas with respect to a molar amount of olefin in the raffinates in which hydrogen is dissolved is 1.0 to 1.5.

3. The method of claim 1, wherein the liquid hydrogenation process is performed at a temperature outside the reactor of 45 to 55° C. and a pressure in the reactor of 15 to 30 $kg/cm^2$ g.

4. The method of claim 1, wherein the liquid hydrogenation process has a recycle ratio of 2.5 to 5.0.

5. The method of claim 1, wherein the space velocity in the reactor of the raffinates in which hydrogen is dissolved is 6 to 10 $hr^{-1}$.

6. The method of claim 1, wherein the raffinates include, with respect to the total amount of 100% by weight, 15 to 30% by weight of normal paraffin, 45 to 70% by weight of isoparaffin, 3 to 10% by weight of olefin, and a remaining percent by weight of other impurities.

7. The method of claim 6, wherein the raffinates include 10 to 15% by weight of C6 normal paraffin with respect to the total amount of 100% by weight.

8. The method of claim 1, wherein the adsorption process includes a) passing an effluent of the liquid hydrogenation process through an adsorption column filled with a zeolite adsorbent in a gaseous state to selectively adsorb normal paraffin and discharging unadsorbed isoparaffin-containing oil to the outside of the adsorption column;

b) discharging the isoparaffin-containing oil remaining between the zeolite adsorbent particles from the adsorption column by concurrent purging with butane after step a); and c) desorbing and discharging the normal paraffin adsorbed in pores of the zeolite adsorbent by countercurrent purging with the butane after step b).

9. The method of claim 8, wherein the adsorption process further includes d) separating a mixture of the normal paraffin and butane discharged in step c) from each other by distillation in an extract column, separating a mixture of the isoparaffin-containing oil and butane discharged in steps a) and b) from each other by distillation in a raffinate column, and recycling the separated butane to the adsorption column.

10. The method of claim 8, wherein in the adsorption process, steps a) to c) are sequentially performed in a continuous circulation manner using at least three or more adsorption columns, and a switching time of each adsorption column is determined by analyzing the raffinates and effluent components of the adsorption column online in real time.

11. The method of claim 8, wherein in steps b) and c), butane having a normal butane content of 70 to 100% by weight is used.

12. The method of claim 8, wherein steps a) to c) are performed under conditions in which a temperature is 150 to 400° C., a pressure is 5 to 20 $kg/cm^2$ g, and a space velocity of raw materials fed into the adsorption column is 1 to 10 $hr^{-1}$.

13. The method of claim 10, wherein when the switching time is determined, the online analysis is performed using a near-infrared analysis system.

* * * * *